US005079013A

United States Patent [19]

Belanger

[11] Patent Number: 5,079,013

[45] Date of Patent: Jan. 7, 1992

[54] DRIPLESS LIQUID FEEDING/TRAINING CONTAINERS

[76] Inventor: Richard A. Belanger, 16 Lamprey Rd., Kensington, N.H. 03827

[21] Appl. No.: 575,358

[22] Filed: Aug. 30, 1990

[51] Int. Cl.[5] ..... A61J 9/00

[52] U.S. Cl. ..... 426/115; 215/11.4; 215/11.5; 222/490; 426/117

[58] Field of Search ..... 426/115, 117; 215/11.1, 215/11.4, 11.5; 222/482, 490, 571

[56] References Cited

U.S. PATENT DOCUMENTS

| | | | |
|---|---|---|---|
| 2,608,841 | 9/1952 | Rice | 215/11.5 |
| 2,753,068 | 7/1956 | Robinson | 215/11.4 |
| 2,876,772 | 3/1959 | Witz | 215/11.4 |
| 4,135,513 | 1/1979 | Arisland | 215/11.4 |
| 4,946,062 | 8/1990 | Coy | 215/11.4 |

*Primary Examiner*—George Yeung
*Attorney, Agent, or Firm*—Frederick R. Cantor

[57] ABSTRACT

Dripless liquid training/feeding containers, being either a cup and/or a bottle, are described, particularly useful and suitable for babies, toddlers, as well as others requiring them. In operation, a liquid is first placed into, for temporary storage within the container's liquid housing. The container housing is then enclosed by a removably-mounted container sealing lid. During use by a baby or toddler, the liquid stored within the container, is slowly sucked or sipped out of the container's liquid housing, by means of a liquid outlet control valve, incorporated preferably within the container's sealing lid. As the liquid is removed by the user sucking or sipping through the liquid outlet control valve, located within a drinking spout, an air inlet control valve, which may preferably be also incorporated within the container's sealing lid, or in the liquid housing acting in concert with the liquid leaving the container, allows air to flow into the cup, during the sipping, resulting in equalization of the interior/exterior pressures, which, at the same time, results in filling of the space previously occupied by the liquid, that has been sipped out of the cup housing. During the sipping/sucking process, as well as non-use, the container, in all likely orientations and movements, will not drip its liquid contents, while outside the user's mouth.

15 Claims, 1 Drawing Sheet

DRIPLESS LIQUID FEEDING/TRAINING CONTAINERS

BACKGROUND OF THE INVENTION

The present invention relates to liquid feeding/training containers, such as toddler sipping cups and baby feeding bottles.

The present invention also relates to liquid drinking and/or feeding/training containers, that are both dripless in use, and are readily adapted for easy sipping by a toddler, or sucking by babies, or others.

The present invention also relates to dripless feeding/training containers, that allow for ready sipping access to the liquid contained within, by means of a dripless, liquid outlet control valve means.

The present invention further relates to dripless liquid feeding/training containers, wherein the liquid that is removed from the liquid housing, by either sipping or sucking, through a liquid outlet control valve means, is readily replaced by air automatically introduced into the container through an air inlet control valve means, thereby equalizing the interior/exterior pressures.

The history of baby and toddler liquid feeding systems, has remained essentially unimproved over a long period of time. The major improvement in baby bottles and toddler cups, formerly manufactured of glass, or other breakable materials, is the replacement of the breakable liquid housing, relatively recently, by plastic, or other non-breakable materials.

In the prior art baby bottle systems, the liquid storage "bottle", or liquid housing, is usually sealed with a flexible latex or silicone rubber nipple. The nipple is usually removably-attached to the bottle by means of a threaded collar, which is designed to squeeze the nipple flange against the rim of the bottle. As the baby sucks on the nipple, the liquid in the bottle is removed by the baby's sucking. As the milk, or other liquid, is removed from the bottle, air will enter the bottle through the nipple, thereby resulting in an equalization of the pressure both inside and outside of the bottle, to that of normal atmospheric pressure.

One of the major problems inherent with the prior art liquid feeding system, is that the baby also ingests a very large amount of air during the difficult process of sucking the milk out of the bottle against the increasing pressures being developed in the bottle. This then results in a "bloating" of the baby's stomach, with the likelihood of concomitant vomiting of the mixture of ingested milk and large amounts of air. A partial "solution" to the ingestion of air during sucking, was arrived at by the use of bottles incorporating disposable, collapsible, polyethylene, or the like, baby bottle liners. However, this has proved to be an expensive alternative, having, as well, its own major problems. Aside from its greater costs, when a bottle utilizing a liner is held upside down, it drips or leaks profusely—the amount being essentially proportional to the size of the nipple liquid outlet. This major drawback, has led to the need for another, more suitable solution, to the vexing air-liquid ingestion problem. Another major problem inherent with the use of the conventional prior art baby bottles, capped by the conventional latex nipple, has been the often uncontrolled spilling or dripping, of large quantities of milk during its use.

As the baby grows into a toddler, the need for a dripless liquid feeding/training sipping cup becomes quite obvious. The previously designed prior art toddler sipping cups, have been usually constructed of a non-breakable plastic, or the like, material, incorporating a tightly-fitting, removable cup sealing lid. The cup's sealing lid, may be either of the 'snap-on/off' or 'screw-on/off'/ version. Generally, the prior art's cup sealing lid, incorporates a 'nipple'- or 'spout-like' liquid outlet protuberance, allowing a child to suck or sip out the liquid contents of the cup.

Further, the cup's lid is usually vented, by means of air holes, in order to provide an adequate sucking or sipping liquid flow. The child then places the 'nipple' or 'spout' in his/her mouth, and then tilts the cup, and sucks or sips, in order to provide the desired liquid flow. However, this prior art design generally also has resulted in the dripping or 'leaking' of large volumes of liquid, when the liquid outlet is not located in the child's mouth. This major problem of prior art liquid feeding/-training cups, or other containers, has led to the demand for a 'simple' solution, which has now been provided by the present invention.

SUMMARY OF THE INVENTION

In accordance with the above discussion: An object of the present invention, is to provide liquid feeding/-training containers, such as toddler liquid sipping cups and baby feeding bottles.

Another object of the present invention, is to provide liquid drinking and/or feeding/training containers, that are both dripless in use, and are adapted for easy sipping by toddlers, or sucking by babies, or others.

Still another object of the present invention, is to provide a dripless liquid feeding/training container, that allows ready sipping access to the liquid contained within, by means of a dripless liquid outlet control valve means.

Still yet another object of the present invention, is to provide dripless liquid feeding/training containers, wherein the liquid that is removed from the liquid housing, by either sipping or sucking, through a liquid outlet control valve means, is readily replaced by air that is automatically introduced through an air inlet valve means, thereby equalizing the interior/exterior pressures.

In an attempt to accomplish the above-listed objects, and at the same time, to solve the problems inherent in the prior art devices, the present invention, teaches and comprises a dripless, liquid feeding/training container, i.e. a bottle and/or a cup, which is particularly useful and suitable for babies, toddlers, as well as others requiring their use. A liquid is previously placed into, for temporary storage within a cup's liquid housing. The container housing is then enclosed by a removably-mounted container sealing lid. During use by a baby or toddler, the liquid is slowly sucked or sipped out of the container's liquid housing, by means of a liquid outlet control valve means, incorporated preferably within the container's sealing lid means. As the liquid is removed by the user sucking/sipping through the liquid outlet control valve means, located within a drinking spout means, an air inlet control valve means, which is preferably also incorporated within the container's sealing lid means, or in the liquid housing means, allows air to flow into the container, during the sipping, resulting in equalization of the interior/exterior pressures, while thereby filling the space previously occupied by the liquid, that has been sipped out of the container housing. During the sucking/sipping process, as well as non-use, the container, in all likely orientations and movements, will not drip its liquid contents, outside the user's mouth.

The present invention, as described, encompasses the following embodiments.

1) A dripless liquid feeding and training container, useful for babies, toddlers, and others, comprising:

a) a liquid housing means;

b) said liquid housing means, further comprising a housing interior, which is suitable for temporary storage of liquids;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid sealing lid means, further comprising a drinking spout means, a liquid outlet control valve means, which is incorporated within, and contiguous to, and is in a liquid inter-connecting relationship with said drinking spout means, and an air inlet control valve means;

g) said drinking spout means, further comprising a liquid outlet, which allows a user to sip or suck liquid driplessly out of said liquid housing; and h) said air inlet control valve means, automatically allowing air to enter said interior of said liquid housing, during the exiting of said liquid, thereby replacing the space formerly occupied by said removed liquid, and equalizing the interior/exterior pressures.

2) A dripless liquid feeding and training cup, useful for babies, toddlers, and others, comprising:

a) a liquid housing means;

b) said liquid housing means, further comprising a housing interior, which is suitable for temporary storage of liquids;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means, further comprising a drinking spout means, a liquid outlet control valve means, which is incorporated within, and contiguous to, and is in a liquid inter-connecting relationship with said drinking spout means, and an air inlet control valve means;

g) said drinking spout means, further comprising a liquid outlet, which allows a user to sip or suck liquid driplessly out of said liquid housing; and h) said air inlet control valve means, automatically allowing air to enter said interior of said liquid housing, during the exiting of said liquid, thereby replacing the space formerly occupied by said removed liquid, and equalizing the interior/exterior pressures.

3) A dripless liquid feeding and training bottle, useful for babies, toddlers, and others, comprising:

a) a liquid housing means;

b) said liquid housing means, further comprising a housing interior, which is suitable for temporary storage of liquids;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means, further comprising a drinking spout means, a liquid outlet control valve means, which is incorporated within, and contiguous to, and is in a liquid inter-connecting relationship with said drinking spout means, and an air inlet control valve means;

g) said drinking spout means, further comprising a liquid outlet, which allows user to sip or suck liquid driplessly out of said liquid housing; and h) said air inlet control valve means, automatically allowing air to enter said interior of said liquid housing, during the exiting of said liquid, thereby replacing the space formerly occupied by said removed liquid, and equalizing the interior/exterior pressures.

4) A dripless liquid feeding and training bottle, useful for babies, toddlers, and others, comprising:

a) a liquid housing means;

b) said liquid housing means, further comprising a housing interior, which is suitable for temporary storage of liquids;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means, further comprising a nipple drinking means;

g) an air inlet control valve means, said air inlet control valve means being incorporated in said liquid housing means;

h) said nipple drinking means, further comprising a liquid outlet, which allows a user to sip or suck liquid driplessly out of said liquid housing; and i) said air inlet valve means, automatically allowing air to enter the interior of said liquid housing, during the exiting of said liquid, thereby replacing the space formerly occupied by said removed liquid, and equalizing the interior/exterior pressures.

5) A liquid feeding/training container, as described in paragraph 1 above, wherein said liquid container is a baby feeding bottle.

6) A liquid feeding/training container, as described in paragraph 1 above, wherein said liquid container is a liquid feeding/training cup.

7) A liquid feeding/training container, as described in paragraph 1 above, wherein said liquid housing means and said sealing lid means, may be configured in any one of desired numerous configurations, such as, but not limited to, a liquid feeding/training cup, a baby feeding bottle, or the like.

8) A liquid feeding/training container, as described in paragraph 1 above, wherein said drinking spout means, in conjunction with, contiguous to, and inter-communicating with, said incorporated liquid outlet control valve means, provides a user with dripless ready access, by means of sipping or sucking, to the liquid located within said liquid housing means.

9) A liquid feeding/training cup, as described in paragraph 2 above, wherein said drinking spout means, in conjunction with, contiguous to, and inter-communicating with, said liquid control valve means, provides a user with dripless ready access, by means of sipping or sucking, to the liquid located within said interior of said liquid housing means.

10) A liquid feeding/training bottle, as described in paragraph 3 above, wherein said drinking spout means, in conjunction with, contiguous to, and inter-communicating with, said incorporated liquid outlet control valve means, provides a user with dripless ready access, by means of sipping or sucking, to the liquid located within said interior of said liquid housing means.

11) A liquid feeding/training container, as described in paragraph 1 above, wherein said air inlet control valve means, allows for ready inflow of air automatically into said liquid housing means during the process of user sucking or sipping of liquid out of said liquid housing means.

12) A liquid feeding/training cup, as described in paragraph 2 above, wherein said air inlet control valve means, allows for ready inflow of air automatically into said interior of said liquid housing means during the process of user sucking or sipping of said liquid out of said interior of said liquid housing means.

13) A liquid feeding/training bottle, as described in paragraph 3 above, wherein said air inlet control valve means, allows for ready inflow of air automatically into said interior of said liquid housing means during the process of user sucking or sipping of said liquid out of said interior of said liquid housing means.

14) A liquid feeding/training bottle, as described in paragraph 4 above, wherein said air inlet control valve means, allows for ready inflow of air automatically into said interior of said liquid housing means during the process of user sucking or sipping of said liquid out of said interior of said liquid housing means.

15) A dripless liquid feeding/training container, as described in paragraph 1 above, wherein said liquid outlet control valve means, further comprises:

a) a valve housing means;

b) said valve housing means, serving as the receptacle for a valve body means;

c) a valve spring means, said valve spring means located concentrically around said valve body means; and d) said valve spring means, serving to allow said valve body means to remain in a valve closed position, until an adequate vacuum is created by sucking at said liquid opening of said drinking spout means, such that said valve body means is moved to a valve open position, allowing liquid to exit through said liquid outlet control valve means.

16) A dripless liquid feeding/training container, as described in paragraph 1 above, wherein said air inlet control valve means, further comprises:

a) a valve spring means;

b) a valve ball means;

c) a valve housing means;

d) said valve housing means, serving as a receptacle for said valve spring means and said valve ball means; and e) said valve spring means, serving to allow said valve ball means to remain in a valve closed position, until an adequate vacuum is created at said interior opening of said air inlet control valve means, such that said valve ball is moved to a valve open position, allowing air to enter said interior of said liquid housing means.

BRIEF DESCRIPTION OF THE DRAWINGS

In order that the present invention may be more fully and readily understood, and, further, that all features thereof may be better appreciated, the present invention will now be described by way of preferred examples, with reference to the accompanying drawings.

DESCRIPTION OF THE PREFERRED EMBODIMENTS OF THE PRESENT INVENTION

Figure 1:
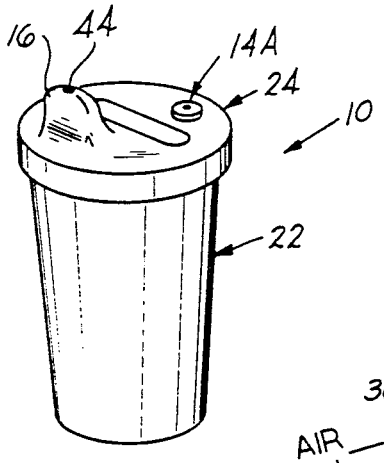
FIG. 1, is a plan view of a preferred embodiment of the dripless, liquid feeding/training cup of the present invention.

As shown in the drawings, for purposes of clarity of illustration, the present invention is depicted in the preferred embodiments, for a dripless liquid feeding/-training cup, and a dripless liquid feeding bottle, of the present invention.

Figure 2:
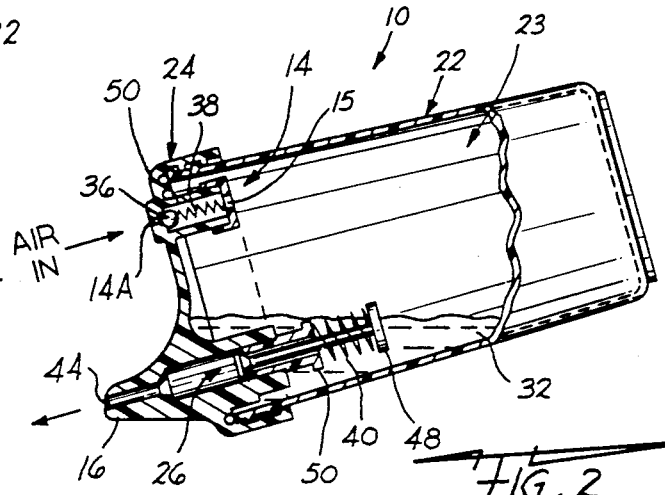
FIG. 2, is a partial, cross-sectional, side view, of a preferred embodiment of the dripless liquid feeding/-training cup of the present invention.

Referring now to FIGS. 1 and 2, which are respectively, a plan view, and a partial, cross-sectional, side view, of a preferred embodiment of the dripless liquid feeding/training cup of the present invention.

The dripless, liquid feeding and training cup of the present invention, is designated generally as 10. The liquid feeding/training cup 10, is comprised of two major portions. In an upright position, as depicted in FIG. 1, the lower portion, is designated as the cup's cup-shaped liquid housing means 22.

The liquid housing 22, and 22A, of both the cup 10, and the bottles 12 and 12A, respectively, of the present invention, may be constructed, if desired, of clear glass, or preferably, a clear or translucent polyvinyl chloride (PVC), a high-density polyethylene, or the like, thermoplastic, or other material, which may be suitably shaped, e.g., molded, blown, or otherwise configured. Removably-attached to the cup's liquid housing 22 portion, is the portion designated as the cup sealing lid means 24. The sealing lid means 24, may be one of a 'snap-on/off', or 'screw-on/off', attachable version. In the preferred embodiments of the present invention, we have depicted the use of a 'screw-on/off' attachable sealing lid 24 means. A major requirement of the removably-attached, cup sealing lid 24, is that the interface point of attachment should be leakproof, thereby preventing leaking of liquids, to be contained within the cup's liquid housing 22, in all possible movements and spatial orientations of the container.

Also, it should be noted that, it may be preferable to apply a 'seal ring', (not shown here), that may be either molded into, or provided as a separate unit, to the inner aspect of the sealing lid 24, i.e. at the interface of the sealing lid 24 and liquid housing 22, in order to create a leakless seal, when the sealing lid 24 is in place, removably-attached to the liquid housing 22.

As seen in FIG. 2's partial, cross-sectional, representation, a liquid 32, is indicated as being temporarily contained within, and partially filling, the interior space of the liquid housing 22. The interior space of the liquid housing 22, is designated as the liquid housing interior 23.

Incorporated preferably within the cup's sealing lid means 24, are a drinking spout means, designated as 16, a liquid outlet control valve means 26, seen fully in FIG.

2, but not in FIG. 1, and the air inlet control valve means 14, also seen fully in FIG. 2, and not in FIG. 1. The drinking spout means 16 and the liquid outlet control valve means 26, are located in a spatially contiguous relationship, and are also in a liquid inter-communicating relationship with each other, through their internal spaces.

It should also be noted that the liquid outlet control valve means 26, of the present invention, further comprises a valve housing means, designated as 50, a valve spring means, designated as 40, and a valve body means, designated as 48.

The air inlet control valve means 14, further comprises a valve housing means, also designated as 50, a valve spring means, designated here as 38, and a valve ball means, designated as 36.

In the normal use of the liquid feeding cup 10 of the present invention, the cup sealing lid 24, is first removed from its removably-attached mounting to the cup's liquid housing 22. Appropriately, water, or nutriment liquid 32, is then poured into the interior 23 of the cup's liquid housing 22, for temporary storage therein. Following the introduction of the liquid 32, into the interior 23 of the liquid housing 22, the cup's sealing lid 24, is then placed back onto the liquid housing 22, in this instance by means of a 'screw-on' attachment action. The toddler, or other user, is then provided access to the liquid feeding cup 10, and holding the cup 10 in his own hands, he/she may easily withdraw the liquid 32, by means of placing the cup's drinking spout means 16, into his/her mouth, and readily sucking or sipping the liquid 32 contents into his/her mouth.

During the sucking/sipping process, liquid 32 will be driplessly drawn out of the drinking spout's opening 44, by means of the concerted and controlled action of liquid 32 removal, through action of the cup's liquid outlet control valve means 26, and simultaneous measured entry of air into the cup interior 23, by the cup's air inlet control valve means 14.

During normal operation, as the child sucks or sips on the cup's drinking spout 16, the vacuum created by sucking or sipping at the spout 16, causes the valve body means 48, of the liquid outlet control valve means 26, to move toward the spout opening 44, into a valve open position, thereby resulting in a flow of liquid 32 out of the cup's interior 23, through the interior spaces of the spout 16 and valve 26, and finally exiting through opening 44. The vacuum pressures required for ready dripless operation of the liquid feeding containers of the present invention, which are described herein, is in the range of from about 4 to about 12 inches in water.

At the same time that liquid 32 is leaving the interior 23, through spout opening 44, outside air automatically enters the interior 23 of the liquid housing 22, without undue pressure restriction, through the action of the air inlet control valve means 14. As the liquid 32 leaves the interior 23 of the liquid housing 22, it creates an interior vacuum, resulting in a pressure differential between the exterior air pressure and interior air pressure. This then results in air entering through the exterior opening 14A, of the valve housing means 50, and passing through the space in the housing 50 of the air inlet control valve 14, and then through the interior opening 15, of the valve housing means 50, as the valve ball means 36 compresses the valve spring means 38, thus allowing external air into the cup interior 23.

Thus, the liquid outlet control valve means 26, of the present invention, provides a liquid flow controlling, as well as checking action, for liquid 32 flowing out of the spout opening 44. This also allows the vacuum, created within the liquid housing interior 23, by the exiting liquid 32 to operate the air inlet control valve means 14, in order to allow outside air to enter the container, which at the same time provides for interior/exterior pressure re-equalization.

Further, the terms, 're-equalization' or 'equalization', as used herein throughout the Application, refer to the process of air entering the container through the air inlet control valve means 14, which results in a 'repressurization' of the container, to a slight interior vacuum of a range from about 3 to about 4 inches of water.

An additional function of the liquid outlet control valve 26, is to retain the 'residual' liquid 32, which has passed through the space of the valve housing 50, of the liquid outlet control valve 26, during sucking, but has not yet escaped through the spout opening 44. This results in any 'residual' liquid 32, still remaining in the interior space of the liquid spout 16, to be held there, and thus will not drip following the removal of the spout 16, from the child's mouth.

Figure 3:
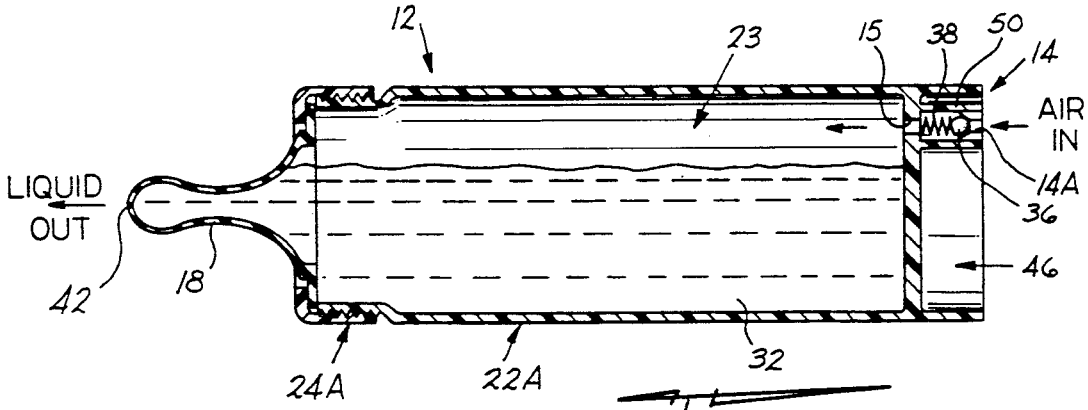
FIG. 3, is a cross-sectional, side view, of a preferred embodiment of the dripless liquid feeding baby bottle of the present invention.

FIG. 3, is a cross-sectional, side view, of a preferred embodiment of the dripless liquid feeding baby bottle, of the present invention. The dripless liquid feeding baby bottle, is designated generally as 12. The liquid feeding baby bottle 12, is comprised of two major portions. In the horizontal orientation of the bottle 12, as depicted in FIG. 3, the major central region of the bottle 12, is the elongated, circular, bottle-shaped portion, being designated as the bottle's liquid housing 22A. Removably-attached to the open-end of the bottle housing 22A, shown on the left, or at the 'top' of the bottle's liquid housing 22A, is the bottle's sealing lid means 24A. The bottle's sealing lid 24A, may be one of the 'snap-on/off' or 'screw-on/off' attachable versions. In the preferred embodiment of the present invention, we have depicted a 'screw-on/off' attachable sealing lid 24A. The 'screw-on/off' sealing lid 24A, may well be the preferred choice for most applications with the liquid feeding baby bottle 12, as depicted in the embodiments of the present invention. A major requirement of the removably-attached baby bottle's sealing lid 24A, is that the point of removable attachment should be leak-proof, in order to prevent leaking of liquids contained within the liquid housing 22A, in all possible movements and spatial orientations of the baby feeding bottle 12. As in the cup 10, previously described, a 'seal ring' (not shown), may also be utilized at the interface between the liquid housing 22A and sealing lid means 24A.

In FIG. 3's cross-sectional representation, a liquid 32, is indicated as being temporarily contained within, and partially filling, the liquid housing interior 23, of the bottle's liquid housing 22A. Integrally attached to the closed, or bottom portion, of the liquid housing 22A, seen here on the right, the bottle being shown horizontally tipped on its side, is a region designated as the feeding bottle housing base 46. In the particular embodiment of the present invention, as illustrated in FIG. 3, and now being described, a liquid outlet control valve means, is not employed. Rather, a conventional baby liquid feeding bottle nipple means 18, may be employed in this embodiment. The nipple 18, additionally incorporates a nipple liquid outlet 42. In FIG. 3, situated within the space delimiting the bottle housing base 46, there is an air inlet control valve means 14, similar in structure to the air inlet control valve as described above in the cup, which, as also described above, serves to allow outside air to automatically flow into the liquid housing 22A away from the exiting liquid 32, to replace the space previously occupied by the liquid 32, as it is being drawn out of the interior 23 of liquid housing 22A, which at the same time results in the equalizing of the interior/exterior pressures. Based on the above, it is to be noted that essentially a conventional nipple means having a nipple liquid outlet, along with an air inlet control valve means 14, as described in the preferred embodiment of the present invention, will also result in a dripless liquid feeding bottle.

The air inlet control valve means 14, when utilized with a conventional baby bottle, with a conventional nipple means 18, allows external air to enter separately, away from, and not through the nipple, which avoids the baby's ingesting large volumes of air into its stomach, and also avoids the dripping problem inherent in the prior art baby bottle using the disposable bag liner system.

In the normal use of the liquid feeding bottle 12, of the present invention, the bottle sealing lid means 24A, which fits over, and incorporates the nipple 18, is removed from its temporary attachment to the bottle housing means 22A. Water, or nutriment liquid 32, is then poured into the liquid housing interior 23, of the bottle's liquid housing 22A. Following the introduction of the liquid 32, into the interior 23 of the liquid housing 22A, the bottle sealing lid 24A, incorporating the nipple means 18, is then placed back onto the liquid housing 22A, in this instance, by means of a 'screw-on' attachment action of the sealing lid 24A. The baby is then provided access to the liquid feeding bottle 12, and may readily suck the liquid 32 contents out of housing interior 23, out through the nipple liquid outlet 42, and into his/her mouth.

During the baby's sucking process, liquid 32 will be readily, i.e., without undue pressure restriction, and without excess air ingestion, be drawn out of the nipple liquid outlet 42, by means of the concerted action of the bottle's nipple liquid outlet 42, and by means of the vacuum being produced by the exiting liquid 32, the outside air will be automatically drawn into the bottle's housing interior 23, in conjunction with, and controlled by, the action of the bottle's air inlet control valve means 14.

Figure 4:
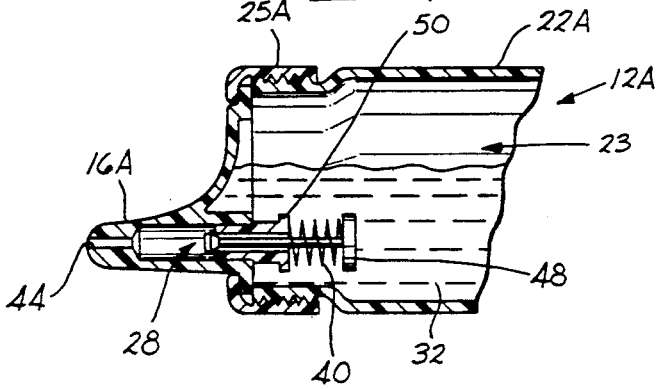
FIG. 4, is a partial, cross-sectional, side view, of an alternate preferred embodiment of the dripless liquid feeding baby bottle of the present invention.

Turning now to FIG. 4, which is a partial, cross-sectional, side view, of an alternate preferred embodiment of the dripless liquid feeding baby bottle of the present invention. In FIG. 4, the major variation between this alternate embodiment of the dripless baby bottle, designated here as 12A, and the embodiment shown in FIG. 2, depicted as 12, is the modified structure of the sealing lid means, depicted here as 25A, and its associated elements. In this alternate embodiment, i.e. 12A, the sealing lid means 25A, incorporates a liquid outlet control valve means, depicted here as 28. The liquid outlet control valve means 28, shown here, is essentially the same means as that shown utilized in the embodiment of the cup 10, seen in FIG. 2. The liquid outlet control valve means 28, is now incorporated within, and contiguous to, the appropriately configured drinking spout means 16A region, of the sealing lid means 25A. In this embodiment, although not shown in this partial view, but located in the region of the bottle housing base 46 (also not shown), is an air inlet control valve means 14, which is also essentially the same means as the one shown in FIG. 3, and depicted there also as 14.

In the normal operation of using the alternate embodiment of the liquid feeding baby bottle 12A, shown in FIG. 4, the child sucks or sips on the bottle's spout means 16A. The vacuum created by the sucking/sipping at the spout means 16A, causes the liquid outlet control valve means 28 to open, by the valve body means 48, moving in the direction of the drinking spout opening 44, resulting in the flow of liquid 32, through the spout's inner spaces and spout opening 44, out of the bottle's liquid housing interior 23. At the same time that liquid 32 is exiting the bottle's interior 23, through the liquid outlet valve means 28 and the drinking spout opening 44, outside air automatically enters the interior 23, of the liquid housing 22A, due to the vacuum created by the exiting liquid 32, without undue pressure restriction, through similar movements of the components of the air inlet control valve means 14. This also results in an equalization of the interior/exterior pressures.

As discussed above, in the embodiments of the liquid feeding containers of the present invention, employing a liquid outlet valve means 28, an additional function of the cup and bottle's liquid outlet control valve means 26 and 28, respectively, is to retain the residual liquid 32, which has passed through the interior space of the liquid outlet valve means 28 during sucking, but has not yet escaped through the drinking spout opening 44. This results in any residual liquid 32, still remaining in the interior space of the liquid spouts 16 and/or 16A, to be held there, by a very slight vacuum still remaining in the interior spaces of 16 or 16A, and the liquid 32 will not drip following removal of the drinking spout means, either 16 or 16A, from the child's mouth.

It is also envisioned that the preferable liquid outlet control valve means 26 and 28, respectively, of the cup and bottle embodiments of the present invention, may be a one-piece, removable assembly. However, in certain applications, the liquid outlet control valve means, may also be a multi-piece, removable or non-removable assembly. As previously indicated, the liquid outlet valve means, is preferably mounted in the cup or bottle's sealing lids means, i.e., 24 and 25A, respectively, contiguous to, and in liquid intercommunication with the spout's, liquid opening 44.

It should also be re-emphasized that the liquid outlet valves 26 and 28, and the air inlet valve 14, work in concert with each other, so that outside replacement air is 'metered' back into the interior 23 of the liquid feeding container, consistent with liquid 32 flow out of the container, thereby resulting in the 'dripless' feeding container, of the present invention.

It is also to be noted that the control valve means employed herein, i.e. both the liquid outlet control valves 26, as well as the air inlet control valves 14, may be either integrally molded into the sealing lid and/or the housing of the container, or, in the alternative, they may be removable units, for ready cleaning, etc., located in the sealing lid and/or the housing of the containers. When the liquid outlet valves 26 and 28, and the air inlet valves 14, are both mounted in a sealing lid means, as in embodiments of the present invention, they may be located at 180 degrees, to each other, or in another convenient spatial relationship to each other. Note also, that if removable valves are employed, the valves may later be removed from the cup as child grows older, resulting in a conventional feeding cup, if so desired. Also, the valves, if removable, may, for example, be threaded to be seated into appropriately threaded receptacles in the sealing lid and/or liquid housing portions.

It is further envisioned, that in certain specific embodiments of the present invention, the air inlet control valve means 14, may be replaced by either a 'simpler' air inlet control valve means 14, e.g., one having fewer components, or by a simple 'pin hole' type air inlet vent hole.

It should also be noted that valves suitable for the embodiments of the present invention, exist in numerous forms and types, such as those shown in the present invention, including, but not limited to, e.g. ball valves, needle valves, flat-handled valves, etc.

Further, it may be re-emphasized that the liquid feeding cup and bottle embodiments of the present invention are functionally 'dripless', that is, the liquid feeding/-training containers are completely 'dripless', either in use or non-use, in all spatial orientations and movements, inside or outside the mouth, from either the liquid outlet control valve means 26 or 28, the air inlet control valve means 14, or the attachment point situated at the interface between the sealing lids 24, 24A and 25A, and the liquid housing means 22 or 22A.

Finally, no unnecessary limitations should be understood or implied from the description of embodiments herein, as all appropriate mechanical and functional equivalents to the above, which may be obvious to those skilled in the arts pertaining thereto, are considered to be encompassed within the claims of the present invention.

What is claimed is:

1. A dripless liquid feeding and training container, useful for babies, toddlers, and others, comprising:

a) a liquid housing means;

b) said liquid housing means, further comprising a housing interior, which is suitable for temporary storage of liquids at an interior pressure;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means further comprising a drinking spout means, a liquid outlet control valve means, which is incorporated within, and contiguous to, and is in a liquid inter-connecting relationship with said drinking spout means, and an air inlet control valve means;

g) said drinking spout means further comprising a liquid outlet, which allows a user to sip or suck liquid driplessly out of said liquid housing means; and h) said air inlet control valve means additionally including further means for automatically allowing air to enter said interior of said liquid housing means during the exiting of said liquid, thereby replacing the space formerly occupied by said removed liquid, and re-equalizing the interior pressure of said liquid housing means with pressure exterior to the liquid housing means.

2. A dripless liquid feeding and training cup, useful for babies, toddlers, and others, comprising:

a) a liquid housing means;

b) said liquid housing means, further comprising a housing interior, which is suitable for temporary storage of liquids at an interior pressure;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means further comprising a drinking spout means, a liquid outlet control valve means, which is incorporated within, and contiguous to, and is in a liquid inter-connecting relationship with said drinking spout means, and an air inlet control valve means;

g) said drinking spout means further comprising a liquid outlet, which allows a user to sip or suck liquid driplessly out of said liquid housing means; and h) said air inlet control valve means additionally including further means for automatically allowing air to enter said interior of said liquid housing means during the exiting of said liquid, thereby replacing the space formerly occupied by said removed liquid, and re-equalizing the interior pressure of said liquid housing means with pressure exterior to the liquid housing means.

3. A dripless liquid feeding and training bottle, useful for babies, toddlers, and others, comprising:

a) a liquid housing means;

b) said liquid housing means, further comprising a housing interior, which is suitable for temporary storage of liquids at an interior pressure;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means further comprising a drinking spout means, a liquid outlet control valve means, which is incorporated within, and contiguous to, and is in a liquid inter-connecting relationship with said drinking spout means, and an air inlet control valve means;

g) said drinking spout means further comprising a liquid outlet, which allows user to sip or suck liquid driplessly out of said liquid housing means; and h) said air inlet control valve means additionally including further means for automatically allowing air to enter said interior of said liquid housing means during the exiting of said liquid, thereby replacing the space formerly occupied by said removed liquid, and re-equalizing the interior pressure of said liquid housing means with pressure exterior to the liquid housing means.

4. A dripless liquid feeding and training bottle, useful for babies, toddlers, and others, comprising:

a) a liquid housing means;

b) said liquid housing means, further comprising a housing interior, which is suitable for temporary storage of liquids at an interior pressure;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means further comprising a nipple drinking means;

g) an air inlet control valve means, said air inlet control valve means being incorporated in said liquid housing means;

h) said nipple drinking means further comprising a liquid outlet, which allows a user to sip or suck liquid driplessly out of said liquid housing means; and i) said air inlet valve means additionally including further means for automatically allowing air to enter the interior of said liquid housing means during the exiting of said liquid, thereby replacing the space formerly occupied by said removed liquid, and re-equalizing the interior pressure of said liquid housing means with pressure exterior to the liquid housing means.

5. A liquid feeding/training container, as described in claim 1 wherein said liquid container is a baby feeding bottle.

6. A liquid feeding/training container, as described in claim 1 wherein said liquid container is a liquid feeding/training cup.

7. A liquid feeding/training container, as described in claim 1 wherein said liquid housing means and said sealing lid means, are configured in any one of desired numerous configurations, but not limited to, a liquid feeding/training cup and a baby feeding bottle.

8. A liquid feeding/training container, as described in claim 1 wherein the further means of said air inlet control valve means comprising a valve spring means and a valve ball means.

9. A liquid feeding/training cup, as described in claim 2 wherein the further means of said air inlet control valve means comprising a valve spring means and a valve ball means.

10. A liquid feeding/training bottle, as described in claim 3 wherein the further means of said air inlet control valve means comprising a valve spring means and a valve ball means.

11. A liquid feeding/training bottle, as described in claim 4 wherein the further means of said air inlet control valve means comprising a valve spring means and a valve ball means.

12. A dripless liquid feeding/training container, as described in claim 1 wherein said liquid outlet control valve means, further comprises:

a) a valve housing means;

b) said valve housing means, serving as the receptacle for a valve body means;

c) a valve spring means, said valve spring means located concentrically around said valve body means; and d) said valve spring means, serving to allow said valve body means to remain in a valve closed position, until an adequate vacuum is created by sucking at said liquid opening of said drinking spout means, such that said valve body means is moved to a valve open position, allowing liquid to exit through said liquid outlet control valve means.

13. A dripless liquid feeding/training container, as described in claim 1 wherein said air inlet control valve means, further comprises:

a) a valve spring means;

b) a valve ball means;

c) a valve housing means;

d) said valve housing means, serving as a receptacle for said valve spring means and said valve ball means; and e) said valve spring means, serving to allow said valve ball means to remain in a valve closed position, until an adequate vacuum is created at said interior opening of said air inlet control valve means, such that said valve ball is moved to a valve open position, allowing air to enter said interior of said liquid housing means.

14. A dripless liquid feeding and training container, useful for babies, toddlers, and others, comprising:

a) a liquid housing means;

b) said liquid housing means, further comprising a housing interior, which is suitable for temporary storage of liquids at an interior pressure;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means further comprising a drinking spout means, a liquid outlet control valve means, which is incorporated within, and contiguous to, and is in a liquid inter-connecting relationship with said drinking spout means, and an air inlet control valve means;

g) said drinking spout means further comprising a liquid outlet, which allows a user to sip or suck liquid driplessly out of said liquid housing means;

h) said air inlet control valve means additionally including further means automatically allowing air to enter said interior of said liquid housing means during the exiting of said liquid, thereby replacing the space formerly occupied by said removed liquid, and re-equalizing the interior pressure of said liquid housing means with pressure exterior to the liquid housing means; said liquid outlet control valve means, further comprises:

i) a valve housing means;

j) said valve housing means, serving as the receptacle for a valve body means;

k) a valve spring means, said valve spring means located concentrically around said valve body means; and l) said valve spring means, serving to allow said valve body means to remain in a valve closed position, until an adequate vacuum is created by sucking at said liquid opening of said drinking spout means, such that said valve body means is moved to a valve open position, allowing liquid to exit through said liquid outlet control valve means.

15. A dripless liquid feeding and training container, useful for babies, toddlers, and others, comprising:

a) a liquid housing means;

b) said liquid housing means, further comprising a housing interior, which is suitable for temporary storage of liquids at an interior pressure;

c) said liquid housing means containing a liquid;

d) a liquid housing sealing lid means;

e) said liquid housing sealing lid means, being removably-attached to said liquid housing means, such that it fully encloses said liquid, contained within said housing interior of said liquid housing means;

f) said liquid housing sealing lid means further comprising a drinking spout means, a liquid outlet control valve means, which is incorporated within, and contiguous to, and is in a liquid inter-connecting relationship with said drinking spout means, and an air inlet control valve means;

g) said drinking spout means further comprising a liquid outlet, which allows a user to sip or suck liquid driplessly out of said liquid housing means;

h) said air inlet control valve means additionally including further means for automatically allowing air to enter said interior of said liquid housing means during the exiting of said liquid, thereby replacing the space formerly occupied by said removed liquid, and re-equalizing the interior pressure of said liquid housing means with pressure exterior to the liquid housing means; said further means of said air inlet control valve means comprises:

i) a valve spring means;

j) a valve ball means;

k) a valve housing means;

l) said valve housing means, serving as a receptacle for said valve spring means and said valve ball means; and m) said valve spring means, serving to allow said valve ball means to remain in a valve closed position, until an adequate vacuum is created at said interior opening of said air inlet control valve means, such that said valve ball is moved to a valve open position, allowing air to enter said interior of said liquid housing means.

* * * * *